United States Patent [19]

Harris

[11] 4,187,418

[45] Feb. 5, 1980

[54] COMBINATION PEDESTRIAN SIGN AND PUSH BUTTON

[76] Inventor: Richard C. Harris, 30 Westwood Rd., Medford, Mass. 02155

[21] Appl. No.: 920,829

[22] Filed: Jun. 30, 1978

[51] Int. Cl.[2] ..... H01H 9/02

[52] U.S. Cl. ..... 200/295; 40/606; 174/45 R; 340/31 R; 340/44

[58] Field of Search ..... 40/606, 607, 331, 332; 340/31 R, 44; 174/45 R; 200/295

[56] References Cited

U.S. PATENT DOCUMENTS

| | | | |
|---|---|---|---|
| 1,096,580 | 5/1914 | Webb | 40/607 |
| 1,805,406 | 5/1931 | Lackner | 340/31 R |

FOREIGN PATENT DOCUMENTS

| | | | |
|---|---|---|---|
| 415434 | 8/1934 | United Kingdom | 340/44 |

*Primary Examiner*—Houston S. Bell, Jr.
*Attorney, Agent, or Firm*—Morse, Altman, Oates & Bello

[57] ABSTRACT

An integrated combination pedestrian sign and push button is provided for use particularly with respect to the mounting of pedestrian actuated switches for controlling traffic lights. A saddle is formed with a semi-cylindrical, longitudinally extending, concave rear face conforming to the contour of a cylindrical post to which the unit is normally mounted and a front face formed with raised letters presenting pedestrian information. The upper and lower ends of the saddle are formed wtih arcuate grooves on the front face thereof for engagement by metal banding straps employed to secure the saddle to an appropriate post. A manually operated push button switch for pedestrians is mounted to the lower front face of the saddle for connection with traffic signal control circuits.

3 Claims, 4 Drawing Figures

FIG.4
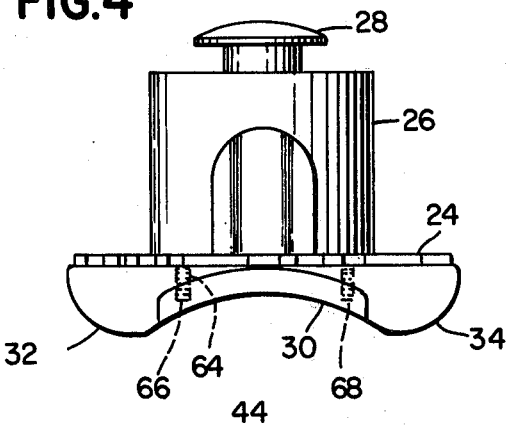
FIG. 3
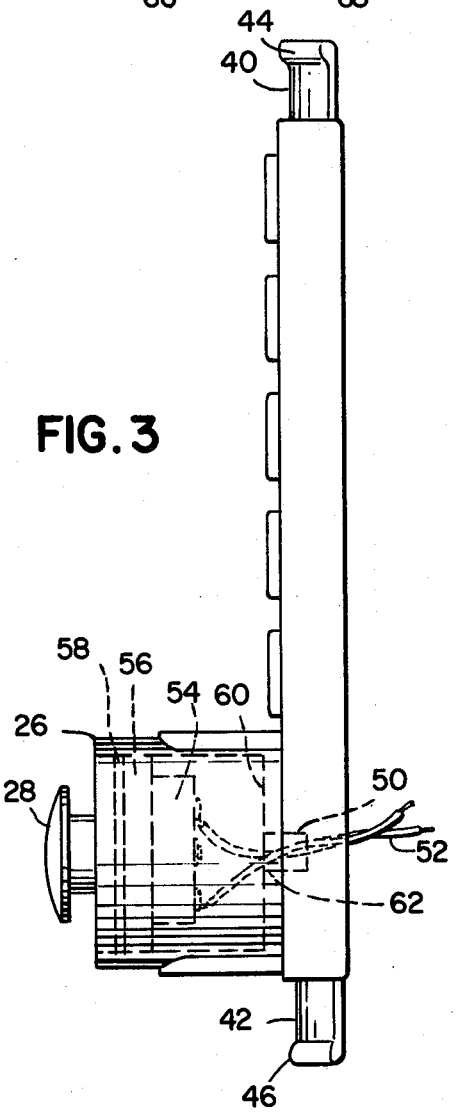
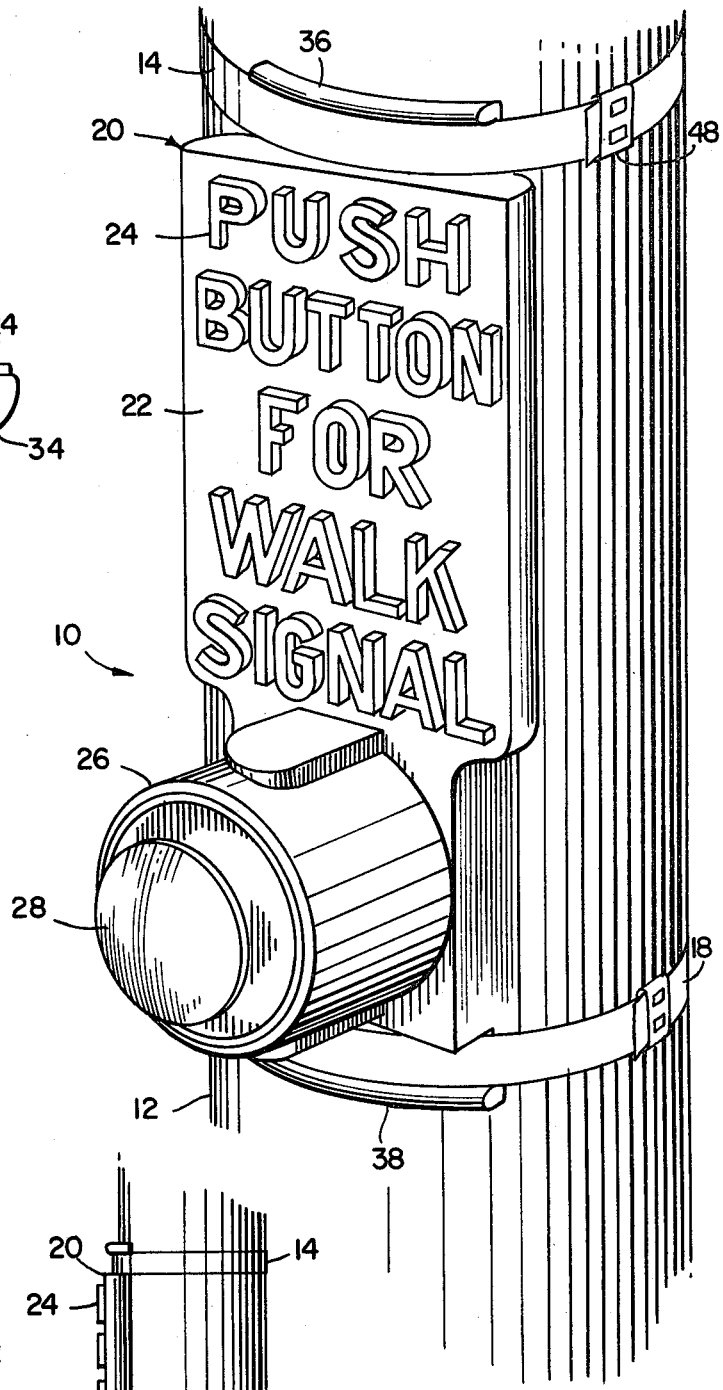
FIG. 1
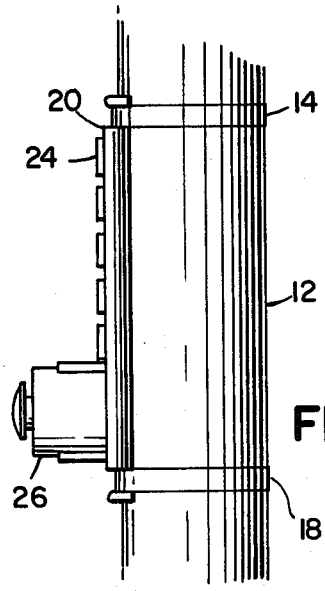
FIG. 2

COMBINATION PEDESTRIAN SIGN AND PUSH BUTTON

BACKGROUND OF THE INVENTION

1. Field of the Invention

This invention relates generally to traffic control devices and more particularly is directed towards a new and improved combination pedestrian sign and traffic control switch.

2. Description of the Prior Art

Located at many traffic intersections which are provided with traffic lights, there is a pedestrian operated push button switch by means of which a pedestrian can turn the traffic lights to red to allow the pedestrian to walk safely across the street. These pedestrian control devices have taken a variety of forms some of which include a control button on the front face with illuminated instructions on it which advise the pedestrian when to walk and when to wait. Such devices are normally mounted in a relatively large housing and are relatively complex and expensive in addition to requiring frequent maintenance. Other units have involved an assembly of parts including a backing plate on the face of which is mounted a flat sign bearing appropriate instructional material and a push button switch is mounted to the plate and connected to the traffic signal control circuits. Again, such devices tend to be quite expensive and are very time consuming to install since the mounting of each device involves the drilling and tapping of holes in the post on which it is to be mounted and all the various parts must be assembled either in the shop or at the site. Further disadvantages of existing devices of this nature are that the instructions on the signs very often are obliterated by painters doing careless work or the signs may be removed or destroyed by vandals.

Accordingly, it is an object of the present invention to provide a low cost, combination pedestrian sign and saddle mounted push button which is extremely simple and easy to install and is highly resistant to vandals in addition to providing pedestrian instructions that cannot be obscured by painting. Another object of this invention is to provide a combination pedestrian sign and push button that can be quickly and easily installed by unskilled workers without tapping screw holes or the like in the support post.

SUMMARY OF THE INVENTION

This invention features a combination pedestrian sign and push button comprising a saddle formed with a front face and a rear face, the front face bearing raised lettering providing pedestrian instructions and the rear face presenting a semi-cylindrical, longitudinal concave arc generally conforming to the contour of a cylindrical post on which the saddle is mounted. Arcuate grooves are formed on the upper and lower ends of the saddle to engage metal banding straps tightly securing the saddle to the post. On the lower front face of the saddle below the raised lettering is mounted a push button unit carrying a switch connected by wires passing through an aperture in the saddle and extending through an opening in the post for connection with the traffic signal control system.

BRIEF DESCRIPTION OF THE DRAWING

FIG. 1 is a view in perspective of a combination pedestrian sign and push button made according to the invention and installed on a post, FIG. 2 is a view in side elevation thereof, FIG. 3 is a view in side elevation of the unit by itself showing additional details thereof, and, FIG. 4 is a top plan view of the device.

DETAILED DESCRIPTION OF THE PREFERRED EMBODIMENT

Referring now to the drawings, the reference character 10 generally indicates a combination pedestrian sign and push button unit mountable to an upright post 12, or other support by means of bands 14 and 18 strapped about the post 12 and engaging the upper and lower ends of the device 10.

The unit 10 is generally organized about a unitary plaque or saddle 20, typically of cast aluminum or the like, formed with a flat front face 22 bearing in raised letters 24 an appropriate legend for instructing pedestrians in the use of the device. Mounted to the lower portion of the front face of the saddle is a housing 26 at the front of which is a pedestrian actuated push button 28.

The back wall of the device is formed with a longitudinally extending semi-cylindrical face 30 having a radius of curvature generally corresponding with that of the cylindrical post 12 to which the device is to be mounted. The outer rear edges of the device form into a pair of parallel lobes 32 and 34 extending along both long edges thereof to provide rigidity and stability to the plaque and also to eliminate sharp edges thereon.

At the upper and lower ends of the plaque are formed flanges 36 and 38 each having a forwardly facing arcuate groove 40 and 42 terminating in an annular shoulder 44 and 46. The function of the grooves 40 and 42 is to receive and position the banding straps 14 and 18 which encircle the post 12 and extend across the outer curved face of the grooves. The banding straps are applied by known techniques and, typically, the straps are fabricated from stainless steel metal bands the ends of which are fastened by folding and securing with a metal clip 48. The strapping technique eliminates the need for drilling and tapping holes in the post and is highly resistant by vandals. The straps also allow for quick removal by using an appropriate tool so that the device 10 may be replaced or repaired as required. Heretofore devices of this type had been mounted to the pole by drilling holes through the signal device as well as through the post, tapping the holes and then inserting screws. This approach is both time consuming and expensive and is very difficult to carry out particularly in cold, wet weather. It also requires a source of electrical power to operate the drill, tapping tools and the like.

In practice, the plaque or saddle 20 is an aluminum casting although other materials may be used to advantage. Typically, the over all length of the device is approximately 1 ft. with a width of approximately 5" at its widest point. The curved rear face 30, preferably has a radius of curvature on the order of $2\frac{1}{4}$", while the radius of curvature of the annular groove 42, is on the order of $2\frac{1}{2}$". The shoulder 44, preferably has a $2\frac{5}{8}$" radius of curvature, while the lobes 32 and 34, have a 1"radius of curvature. The minimum thickness of the saddle is on the order of $\frac{3}{8}$" with a maximum thickness of about 1" at the lobes.

The lettering 24, preferably is 1" in height each and raised approximately ⅛". For maximum visibility and attention the plaque may be painted a bright yellow with the crests of the letters painted red. Near the lower end of the plaque and along the center line is an opening 50 through which extend leads 52 connected to a switch 54, mounted within the cup-shaped housing 26 and actuated by means of the push button 28. In practice, the opening 50 is aligned with a corresponding opening formed in the post 12 to which the device is mounted and through which the leads 52 are passed for connection with the traffic light control system.

The switch 54 typically is comprised of generally rectangular block of dielectric material mounted to the inner face of a circular disk 56 secured in position against an inner annular shoulder formed in the cup-shaped housing and secured by a threaded annulus 58. The push button 28 is spring mounted to the disk 58 and is provided with a stem which passes through the block to open and close contacts on the inner face of the block 54 to which the leads 52 are attached.

The cup-shaped housing 26 includes an inner transverse wall 60, formed with a pair of holes 62 on opposite sides of the hole 50, and in register with tapped holes 64, formed in the plaque to receive screws 66 and 68 which are provided to mount the cup-shaped housing firmly to the plaque.

The push button unit may be installed on the plaque at the shop or at the site and the assembled unit is then quickly and conveniently mounted to the post by merely locating the device at the proper height with the leads 52 extending through a pre-formed opening in the post. Once in the proper position, the banding straps are applied and secured using tools particularly suited for this purpose. The task is quick and simple and the strapping arrangement will hold the device firmly in place for an indefinite length of time. The raised lettering is advantageous in that the legend will still be readable even if a careless painter should paint over all of the sign without separately painting the letters or wiping off excess paint from the crests of the letters. With a conventional flat sign normally used for this purpose, the legend would be completely obscured by such careless painting. Since the legend is part of the plaque, vandals will find it extremely difficult to remove the plaque and it is impossible to separately remove the signage as can be done with those devices using a separate flat signs attached to a bracket. A further advantage is that there is very little drilling or tapping involved and the device may be mounted in any weather using relatively unskilled workers.

The total cost of the unit is substantially below that of a conventional device of this type in view of the fact that the components are integrated into a single unit.

Having thus described the invention, what I claim and desire to obtain by Letters Patent of the United States is:

1. A combination sign and pushbutton mountable by separate flexible strapping bands to a cylindrical post for pedestrian control of traffic lights, comprising:

(a) a solid plaque, (b) said plaque being formed with front and rear faces, (c) said rear face being contoured in the form of a semi-cylindrical cavity to conform to the contour of said post, (d) said front face being generally flat and formed with integral raised lettering providing an instructional legend for pedestrians, (e) said plaque being formed at the upper and lower portions thereof with forwardly facing arcuate grooves generally concentric with the contour of said rear face and adapted to receive said flexible strapping bands wrapped about said post and along said grooves, and (f) a pushbutton unit mounted to the front face of said plaque, (g) said unit including a housing secured to said plaque, a switch mounted in said housing, a spring biased pushbutton extending through said housing and operatively connected to said switch, and means for connecting said switch to said lights.

2. A combination sign and pushbutton according to claim 1 wherein said plaque and said housing are formed with openings in register with one another for said connecting means.

3. A combination sign and pushbutton according to claim 1 wherein said plaque is formed with an arcuate shoulder adjacent to and concentric with each of said grooves.

* * * * *